US008905816B2

(12) United States Patent
Gramling et al.

(10) Patent No.: US 8,905,816 B2
(45) Date of Patent: Dec. 9, 2014

(54) BLAST MACHINE SYSTEM CONTROLLER

(71) Applicant: Marco Group International, Inc., Davenport, IA (US)

(72) Inventors: Chris Gramling, Geneseo, IL (US); Richard McLaughlin, Moline, IL (US)

(73) Assignee: Marco Group International, Inc., Davenport, IA (US)

( * ) Notice: Subject to any disclaimer, the term of this patent is extended or adjusted under 35 U.S.C. 154(b) by 131 days.

(21) Appl. No.: 13/766,286

(22) Filed: Feb. 13, 2013

(65) Prior Publication Data

US 2013/0210319 A1 Aug. 15, 2013

Related U.S. Application Data

(60) Provisional application No. 61/598,070, filed on Feb. 13, 2012.

(51) Int. Cl.

| | |
|---|---|
| ***B24C 1/00*** | (2006.01) |
| ***B24C 9/00*** | (2006.01) |
| ***B24C 3/00*** | (2006.01) |
| ***B24C 3/04*** | (2006.01) |

(52) U.S. Cl.

CPC ... *B24C 3/00* (2013.01); *B24C 9/00* (2013.01); *B24C 3/04* (2013.01)

USPC ..... 451/2; 451/5; 451/38; 451/75; 451/99

(58) Field of Classification Search

CPC ..... B24C 1/045; B24C 3/322; B24C 7/0046; B24C 3/062; B26F 3/004

USPC ..... 451/2, 5, 8–10, 38–40, 75, 99

See application file for complete search history.

(56) References Cited

U.S. PATENT DOCUMENTS

| | | | | | |
|---|---|---|---|---|---|
| 3,434,241 | A | * | 3/1969 | Greenberg et al. | 451/2 |
| 3,442,053 | A | * | 5/1969 | Lemen | 451/2 |
| 3,529,383 | A | * | 9/1970 | Shumsheruddin et al. | 451/2 |
| 3,768,210 | A | | 10/1973 | Johnson et al. | |
| 4,693,102 | A | * | 9/1987 | Amy et al. | 72/53 |
| 4,821,467 | A | * | 4/1989 | Woodson et al. | 451/2 |
| 5,024,029 | A | | 6/1991 | Abbott et al. | |
| 5,097,633 | A | | 3/1992 | Branton et al. | |
| 5,201,150 | A | * | 4/1993 | Kuboyama et al. | 451/88 |
| 5,239,787 | A | | 8/1993 | Abbott et al. | |
| 5,261,192 | A | * | 11/1993 | Nelson | 451/92 |
| 5,433,653 | A | * | 7/1995 | Friess | 451/38 |
| 5,533,392 | A | | 7/1996 | Kira | |
| 5,613,895 | A | | 3/1997 | Baker | |
| 6,000,995 | A | | 12/1999 | Ruholl | |
| 6,152,810 | A | | 11/2000 | Drenter | |
| 6,575,815 | B1 | * | 6/2003 | Schubert et al. | 451/38 |
| 6,932,670 | B1 | | 8/2005 | Lambrinos | |
| 2004/0106366 | A1 | * | 6/2004 | Robinson et al. | 451/99 |
| 2008/0287039 | A1 | * | 11/2008 | Connelly | 451/38 |
| 2010/0211429 | A1 | | 8/2010 | Benson | |

* cited by examiner

*Primary Examiner* — George Nguyen

(74) *Attorney, Agent, or Firm* — Woodard, Emhardt, Moriarty, McNett & Henry LLP

(57) ABSTRACT

A system for system for controlling functions of a multi-feed blasting apparatus is disclosed. Tank pressure, charge/discharge control, status of a vessel cover, total hours of pressurization or operation for the vessel and individual feed lines, ambient environmental or weather conditions, and abrasive material level inside the vessel may also be monitored and controlled by the disclosed system.

20 Claims, 3 Drawing Sheets

BLAST MACHINE SYSTEM CONTROLLER

REFERENCE TO RELATED APPLICATION

The present application claims the benefit of U.S. Provisional Patent Application Ser. No. 61/598,070 filed Feb. 13, 2012 entitled BLAST MACHINE SYSTEM CONTROLLER which is hereby incorporated by reference in its entirety.

FIELD OF THE INVENTION

Aspects of the present disclosure deal with control systems for abrasive blasting machines.

BACKGROUND OF THE INVENTION

Pressure vessels or "blast pots" are used with various abrasive blasting materials for surface preparation applications. When closed and filled with the blasting material, the pressure vessel is pressurized and used in combination with an air feed line which receives abrasive material from the pressure vessel and then carries the material through a hose to a nozzle when used in a surface preparation application. Some larger blast pots feed multiple outputs, for example to supply material to different work stations. An embodiment of the present disclosure provides a control unit and data collection into which various functions relating to the blasting apparatus and surrounding environment are integrated.

SUMMARY

According to one aspect, the present disclosure provides a control system which integrates various functions of a multi-feed blasting apparatus. Tank pressure, charge/discharge control, status of the vessel cover, total hours of pressurization for the tank and individual feed ports, ambient conditions, and abrasive material level inside the tank are some of the functions and variables which may be monitored and controlled by the disclosed system.

According to another aspect, an abrasive blasting control system is disclosed, comprising an abrasive blasting device having a pressure vessel for storing blasting media and a plurality of individual blast outlet lines connected to the pressure vessel, a control housing associated with the abrasive blasting device, a controller located within the housing and having a processor and a memory, and a plurality of line duration displays mounted to the housing. Each line duration display is operable to display the duration of time that a corresponding one of the blast outlet lines has been in active use. A vessel duration display is mounted to the control housing and is operable to display the duration of time that the pressure vessel has been pressurized. The controller may be configured to receive input from a plurality of line sensors connected to the corresponding plurality of individual blast outlet lines to track the duration of time that the individual abrasive blasting lines have been in active use. The controller may also provide output signals to the individual line duration displays to display the duration information for the individual blasting lines. Reset inputs may also be provided for each of the line duration displays and vessel duration display. The control system may also comprise a hatch status display for indicating the status of the vessel hatch or a locking device connected to the hatch. A media level display may also be included which indicates the amount of blasting media remaining in the pressure vessel.

According to another aspect, an abrasive blasting system is disclosed, comprising a pressure vessel having a plurality of blast outlet lines, a plurality of line sensors operatively connected to the individual blast outlet lines, and a control panel having a plurality of line duration displays. The line duration displays are operable to display the duration of time that a corresponding one if the blast outlet lines has been in active use based on input received from the line sensors. A vessel duration display is mounted to the housing. The vessel duration display is operable to display the duration of time that the pressure vessel has been pressurized.

According to yet another aspect, a method for monitoring an abrasive blasting apparatus is disclosed, comprising receiving input from a plurality of line sensors connected to a corresponding plurality of individual blast outlet lines connected to the abrasive blasting apparatus, and automatically indicating the individual durations of use for each of the individual blast outlet lines based on the input.

DESCRIPTION OF PREFERRED EMBODIMENTS

Figure 1:
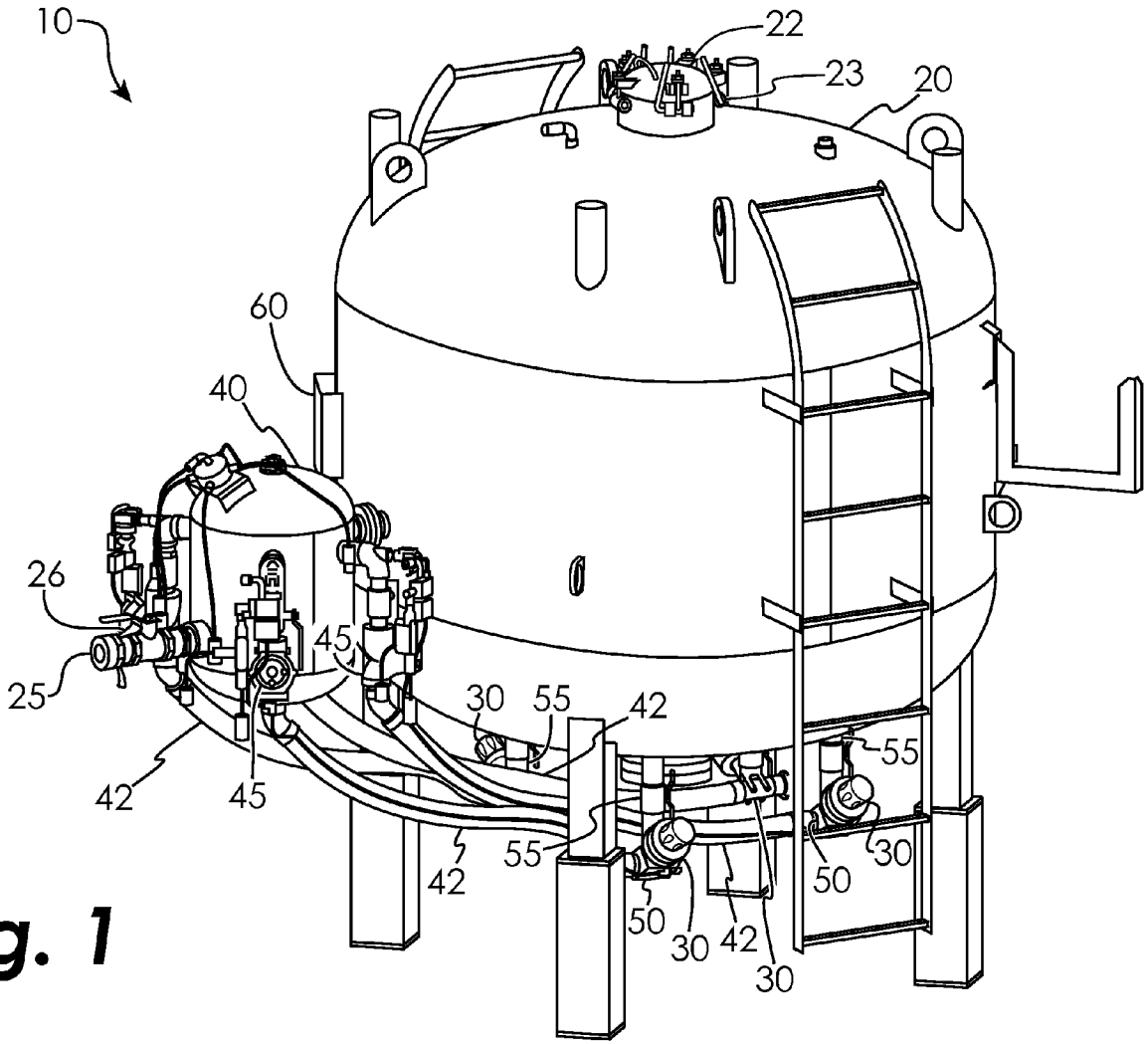
FIG. 1 is a perspective view of a blast machine system according to one embodiment of the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present disclosure provides a system for controlling and monitoring various functions of a blasting machine having multiple blast outlets. By integrating the functions in a single unit, the operator can gain better knowledge of the blast operations and any effects the surrounding environment might present. As a result, increased safety and operational efficiency may be achieved.

FIG. 1 illustrates a blasting system 10 having a pressure vessel 20 for storing an abrasive blasting media, feed air inlet 25, and a plurality of blast outlets 30. As illustrated, four outlets 30 are provided (allowing four users to utilize the system 10 simultaneously), however more or less outlets 30 may be provided depending on the needs of the application. An optional moisture separator 40 may be provided for removing moisture from the incoming air before it reaches the pressure vessel 20 and/or blast outlets 30. The pressure vessel 20 includes a hatch 22 which can be opened to add the blasting media to the vessel and/or for interior inspection and maintenance. The hatch 22 typically includes a locking device, such as the cam-lock closures 23 shown in FIG. 1.

In the illustrated embodiment, pressurized air, from either an external source or a compressor integrated with the system 10, enters the moisture separator 40 via inlet 25 and is then directed through multiple outlets to air lines 42 via air control valves 45. A main inlet shutoff valve 26 may also be provided to isolate the system 10 from the pressurized air source. The blasting media is fed from the bottom of the pressure tank 20 through feed lines 55 and enters metering valves 50. Each metering valve 50 receives the blasting media from a media feed line 55 and pressurized air from an air line 42. As the blasting media enters a metering valve 50, it is propelled by the pressurized air toward the corresponding metering valve outlet 30. Blast hoses (not shown) may be connected to one or more of the metering valve outlets 30 and typically include a nozzle for directing the blast media toward the object being blasted. When a outlet or feed line 55 is not in use, it may be secured with a cap or plug to prevent air and/or blast media from escaping. It shall be understood that the valve 26 may be operated manually or operated remotely by electrical, pneumatic, or mechanical actuators. Valves 45 and 50 may be operated remotely by electrical or pneumatic actuators. In one embodiment, the valves 26, 45 and 50 may comprise electromechanically actuated ball valves, although other types of valves may also be used.

Figure 2:
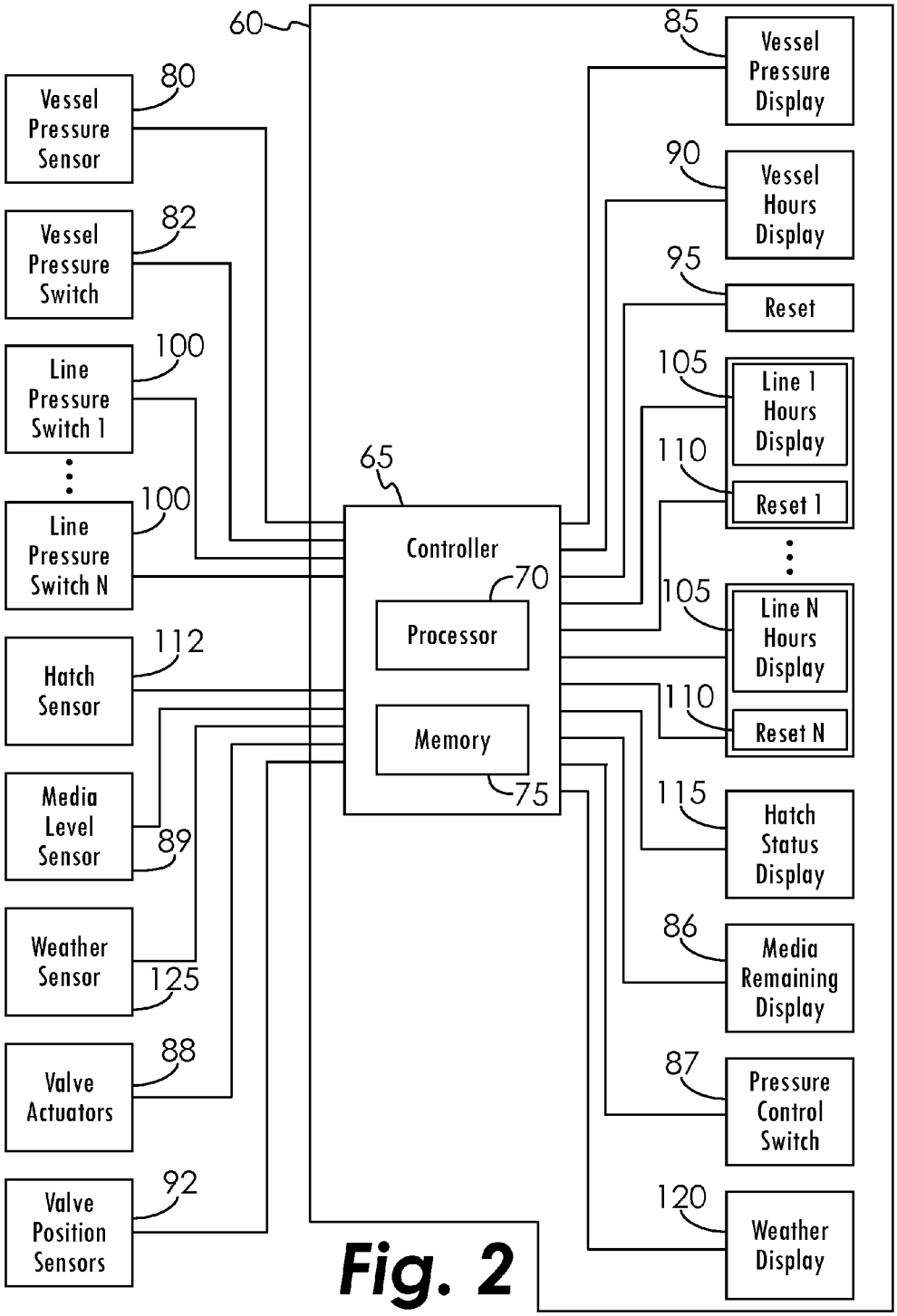
FIG. 2 is a schematic control diagram of a blast machine system control arrangement according to the embodiment of FIG. 1.

The operation of the various valves and other components of the system 10 is monitored and controlled using control station 60, which may be mounted to the pressure tank 20 as shown or mounted in a remote location. As shown in schematic form in FIG. 2 and illustrated in FIG. 3, the control station 60 monitors several conditions and/or variables related to the system 20 including, but not limited to, internal pressure of the pressure tank 20, total time the pressure tank 20 is pressurized, cycle time of each blast outlet 30 when pressurized, state (open, closed, etc.) of the hatch 22, and ambient weather conditions.

The control station 60 comprises a controller 65 for receiving input from monitoring devices and outputting data for display. The controller 65 may also provide outputs for controlling various devices related to the control and operation of the system 10, including regulation and maintenance of the pressure level within the pressure vessel 20, regulation of the mixture of air and blasting media through the system, and regulation of other material flow rates through the system 10. The controller 65 preferably includes a computer processor 70 and a memory 75 for processing and storing information during operation of the system 10. In a preferred embodiment, the control station 60 is configured to operate using 12 volt direct current as the supply power, although other suitable power levels and types may be used, depending on the needs of the particular application.

In one embodiment, a vessel pressure sensor 80 is operatively attached to the pressure vessel 10 in a location which allows the sensor 80 to accurately measure the pressure level inside the pressure vessel 10. The pressure sensor 80 transmits a signal indicative of the pressure level to the controller 65 as shown. The controller 60 receives the signal from the sensor 80 and outputs a corresponding signal to the vessel pressure display 85, which displays the pressure in pounds per square inch or other appropriate units. The vessel pressure display 85 may comprise any suitable electronic display known in the art, such as a liquid crystal display (LCD), light emitting diode (LED) display, or the like. The displays may also take the form of other types of displays, such as dials, gauges, needle indicators, and color-coded lamps. In addition, it shall be understood that still other types of displays may be used to indicate the vessel pressure or other system parameters, including analog, mechanical, and pneumatic displays. It shall also be understood that the signal from the pressure sensor 80 may be connected directly to the display 85, as opposed to being routed through the controller 65.

The control station 60 may also be configured to monitor and/or display the total hours that the pressure vessel 20 is pressurized. In one embodiment, a separate pneumatic switch 82 is attached to the pressure vessel 10 and is triggered whenever the pressure inside the vessel 20 rises above a predetermined level (e.g., 1 psi). The switch 82 is also connected to the controller 65. When the switch is triggered, the controller 65 begins to log and display the total hours that the vessel 20 has been pressurized on display 90. In other embodiments, the controller 65 may further track and display the total hours that the pressure vessel is pressurized and at least one blast outlet line is in active use. In other embodiments, the display 90 may be incremented when any one of the individual blast outlets is in use or when a corresponding individual display for that outlet or line is being incremented. The total hours displayed may be expressed in increments of one tenth of an hour or any other appropriate units. A reset button, such as keyed reset 95, may be provided to reset the total displayed hours to zero as desired.

In addition to total vessel hours, cycle times for the individual blast outlets 30 (i.e., when blast media is being propelled through the blast line during active use) may be monitored and displayed using the control station 60. In one embodiment, individual pneumatic switches 100 (e.g., 1 thru N, if N lines 42 are provided) are installed in a location which causes the switches to be activated when the pressure inside a corresponding individual air line 42 or a hose connected to an individual blast outlet 30, rises above a predetermined pressure. When one of the switches 100 is activated, the controller 65 begins to log and display the total usage hours for that line on the corresponding display 105. In other embodiments, the controller increases the total usage hours based on a switch which is actuated when the operator activates a trigger located near the nozzle of a hose connected to a blast outlet 30. Reset buttons 110 may be provided to reset the individually displayed cycle times as desired.

A hatch sensor 112 may be provided to monitor the state of the hatch 22. In one embodiment, the hatch sensor 112 monitors the state of a locking device (e.g., cam-lock closures 23 and/or other additional hatch locking devices, such as a detent collar securing the cam-lock closures in a closed position) connected to the hatch 22 to determine whether the locking device is actively locked or inactive and potentially unlocked. In other embodiments, the hatch sensor 112 may simply monitor whether the hatch is open or secured, or whether it is safe for the operator to open the hatch 22. The hatch information is transmitted to the controller 65, which displays the hatch status using display 115.

In certain preferred embodiments, the control station 60 may include a weather condition display 120 which displays data relating to ambient weather conditions around the system 10. The displayed data may include ambient temperature, relative humidity, dew point, barometric pressure, wind conditions, and the like. In one embodiment, the weather information is obtained using various weather sensors 125 which are in operative communication with the controller 65, either through wired or wireless mediums. The weather sensors may be mounted within or external to the control station 60. The controller 65 receives the signals from the sensors 125 and translates the information for display on weather display 120. The controller 65 may also receive weather information from independent weather reporting services, such as the National Weather Service. The displayed information allows the operator to assess how local weather conditions may affect operation of the system 10 and/or whether the conditions may affect the surface of the item being treated.

A remote pressurization control switch 87 may also be provided which allows the operator to control an associated valve actuator (e.g., inlet valve 26) or other control device to remotely pressurize or depressurize the vessel 20. In one embodiment, the switch 87 is implemented as a two position double pole/double throw (DPDT) toggle switch. In addition to total tank pressurization or depressurization, additional switches may be included within the control station 60 to allow selective pressurization or depressurization of the individual blast outlets 30. Additional switches may provided to control the state of the various valves and control devices of the system, including air control valves 45, feed valves 50, or other pressure control valves (indicated collectively as 88 in FIG. 2) during operation of the system 10. In certain embodiments, the control station 60 may also receive input from valve position sensors 92 connected to the valves 88 at appropriate locations.

In certain embodiments, the system 10 may also include a display 86 for indicating the amount of blasting media remaining in the vessel 20. The display 86 is fed (either directly or via controller 65) by a media sensor 89 operatively connected to the vessel 10. The media sensor 89 may comprise any material level or quantity sensor known in the art, including, but not limited to, ultrasonic sensors, laser/light sensors, mechanically-actuated sensors, and the like.

It shall be understood that while a single controller 65 is described above as managing and/or translating the various input signals for output on the individual displays, other processor or signal routing configurations are contemplated to be within the scope of the present disclosure. For example, certain signals, such as those received from pressure switches 82 and 100, may bypass the controller 65 and be connected directly to the displays 90 and 105 respectively, when the displays are implemented with built-in circuitry to monitor the state of the switches and cause the hour display to be incremented.

In certain embodiments, the control station 60 may incorporate a data logging system which monitors and records information relating to operation of the system 10 in memory for future reference. Examples of such recorded data include, but are not limited to, total vessel hours, individual outlet hours, usage trends, hatch status, weather data and weather tracking, maintenance interval data, and the like. In still further embodiments, the control station 60 may include a communication module for transferring data from the logging system to a computer, memory device, or handheld mobile device located near the control station 60, through either a wired (e.g., USB, Ethernet, Firewire, or the like) or short range wireless medium (e.g., Bluetooth, RFID, and the like). The control station 60 may also comprise a remote reporting device, such as a cellular network or Wi-Fi transmitter/receiver, for electronically reporting the operational data to a remote location. The control station 60 may also include a global positioning satellite (GPS) receiver/transmitter for recording or reporting the location of the system 10 or for selecting a location for a desired local weather report, such as when the system 10 is implemented on a movable platform or trailer.

Figure 3:
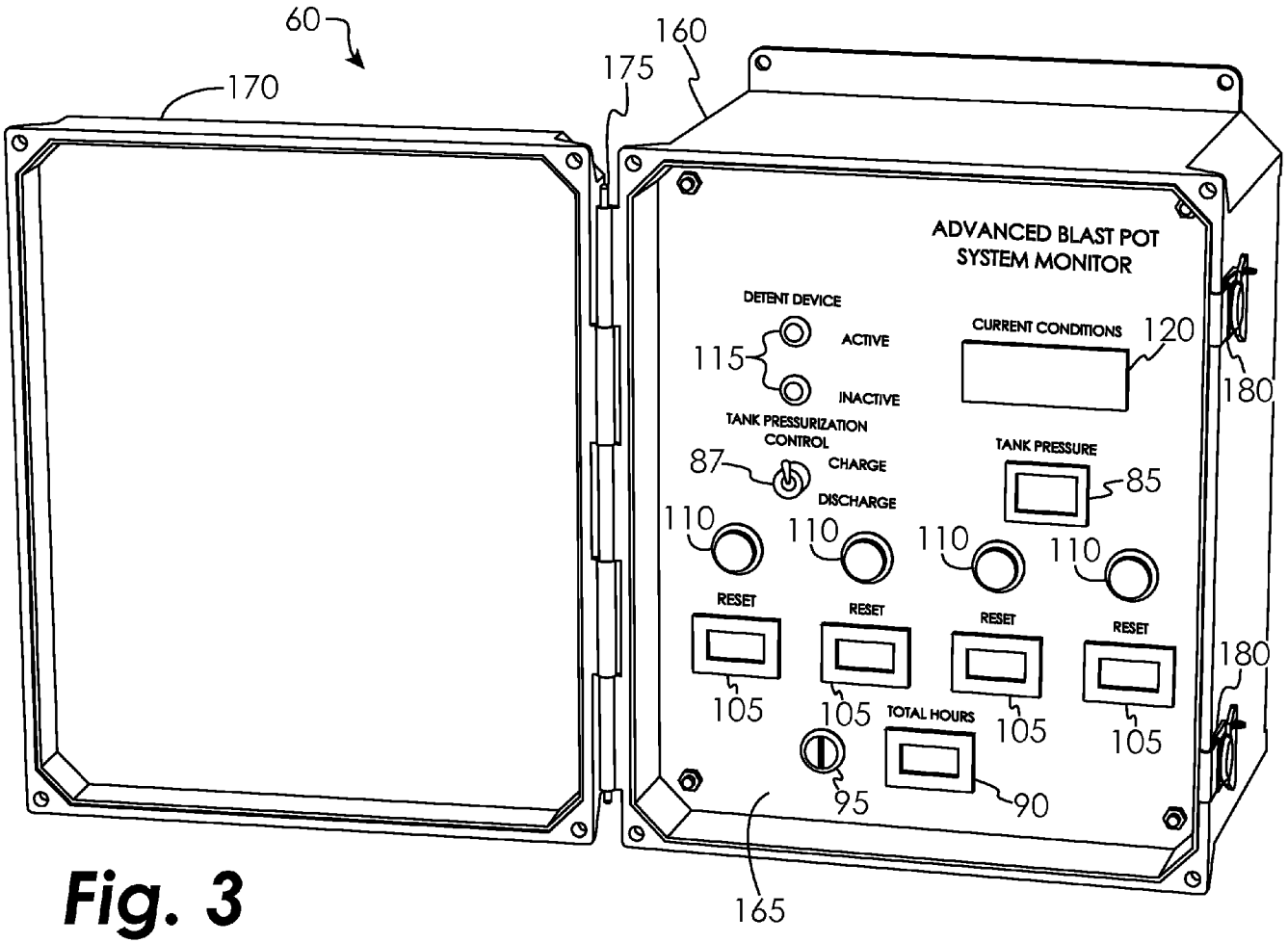
FIG. 3 is a perspective view of a control station according to one embodiment of the present disclosure.

FIG. 3 illustrates a perspective view of one embodiment of the control station 60. As shown, the control station 60 includes a housing 160, a main control panel 165, and a weathertight enclosing door 170 for protecting the panel 165 from the elements. The door 170 may be optionally secured to the housing 160 by hinge 175 and releasable locks 180. The various indicators and remote operator controls described above are preferably arranged within the panel 165 as shown, although other suitable arrangements may be used.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An abrasive blasting control system, comprising:

an abrasive blasting device having a pressure vessel for storing blasting media and a plurality of individual blast outlet lines connected to the pressure vessel;

a control housing associated with said abrasive blasting device;

a controller located within the housing and having a processor and a memory;

a plurality of line duration displays mounted to the housing, each line duration display operable to display the duration of time that a corresponding one of the blast outlet lines has been in active use; and a vessel duration display mounted to the housing, said vessel duration display operable to display the duration of time that the pressure vessel has been pressurized.

2. The system of claim 1, wherein said controller is configured to receive input from a plurality of line sensors connected to said corresponding plurality of individual blast outlet lines and to display said duration of time that the individual abrasive blasting lines have been in active use on said line duration displays.

3. The system of claim 2, wherein said line sensors comprise pressure sensors operatively connected to said blast outlet lines.

4. The system of claim 2, wherein said line sensors comprise contact switches which are triggered when an operator activates a corresponding individual blast outlet line.

5. The system of claim 1, wherein said controller is configured to receive input from a pressure sensor connected to the pressure vessel and display the duration of time that the pressure vessel has been pressurized on said vessel duration display.

6. The system of claim 1, further comprising a weather display mounted to the housing, said weather display operative to automatically display information regarding ambient weather conditions near the blasting device.

7. The system of claim 6, wherein the controller is configured to receive input from at least one weather sensor coupled to the system and automatically display information regarding ambient weather conditions on said weather display.

8. The system of claim 6, wherein the controller is configured to receive weather data from a remote weather data service and automatically display said weather data on the weather display.

9. The system of claim 8, wherein the controller is configured to receive location information from a GPS unit coupled to the system, and to receive said weather data from said remote weather data service using said location information.

10. The system of claim 1, further comprising a hatch status display mounted to the housing, said hatch status display operative to display the status of a hatch mounted to the pressure vessel.

11. The system of claim 10, wherein the hatch status display is operative to display the status of a locking device connected to the hatch.

12. The system of claim 1, further comprising a media level display operable to display the amount of blast media remaining in the pressure vessel.

13. The system of claim 12, wherein said controller is configured to receive input from a media level sensor of the abrasive blasting device and output a value indicative of the level of blast media remaining in the abrasive blasting device.

14. The system of claim 1, further comprising a pressure control operable to control the pressure within the abrasive blasting device.

15. The system of claim 1, wherein the abrasive blasting device and the housing are mounted to a portable platform.

16. The system of claim 1, wherein the controller is configured to store data relating to the duration of active use of the individual blast outlet lines and the pressure vessel duration in the memory.

17. The system of claim 16, further comprising a communication module configured to facilitate wireless transmission of said data.

18. The system of claim 16, further comprising a communication module configured to facilitate downloading of data between the controller and a memory device via a wired medium.

19. An abrasive blasting system, comprising:

a pressure vessel having a plurality of blast outlet lines;

a plurality of line sensors operatively connected to the individual blast outlet lines;

a control panel having a plurality of line duration displays, said line duration displays operable to display the duration of time that the corresponding blast outlet line has been actively dispensing blasting media based on input received from the line sensors; and a vessel duration display mounted to the housing, said vessel duration display operable to display the duration of time that the pressure vessel has been pressurized.

20. A method for monitoring an abrasive blasting apparatus, comprising:

receiving input from a plurality of line sensors connected to a corresponding plurality of individual blast outlet lines connected to the abrasive blasting apparatus;

automatically indicating the individual durations of active use for each of the individual blast outlet lines based on the input.

* * * * *